US005836251A

United States Patent [19]

Hathaway et al.

[11] Patent Number: 5,836,251

[45] Date of Patent: Nov. 17, 1998

[54] ROLL ON—ROLL OFF BIMODAL TERMINAL SYSTEM

[75] Inventors: Richard C. Hathaway, Greenville; Mearl K. Bridges, New Madison; John M. Barr, Lewisburg; Donald R. Klein, Greenville, all of Ohio

[73] Assignee: Kaci Terminal System Ltd., Greenville, Ohio

[21] Appl. No.: 819,548

[22] Filed: Mar. 17, 1997

[51] Int. Cl.[6] ..... B61J 1/00

[52] U.S. Cl. ..... 104/27; 104/28; 104/29; 104/137; 414/333; 414/334

[58] Field of Search ..... 104/27, 29, 30, 104/31, 49, 137; 414/333, 339

[56] References Cited

U.S. PATENT DOCUMENTS

| | | | |
|---|---|---|---|
| 2,168,061 | 8/1939 | Christie et al. | 104/31 |
| 2,903,978 | 9/1959 | Gaynor | 104/29 |
| 2,920,580 | 1/1960 | Williams . | |
| 3,448,693 | 6/1969 | Graham | 105/29 |
| 4,076,134 | 2/1978 | Landow | 414/333 |
| 4,129,079 | 12/1978 | Shannon . | |
| 4,154,170 | 5/1979 | Williams | 104/29 |
| 4,190,393 | 2/1980 | Landow . | |
| 4,421,360 | 12/1983 | Newton . | |
| 4,441,764 | 4/1984 | Newton . | |
| 4,453,777 | 6/1984 | Newton . | |
| 4,483,652 | 11/1984 | Barry . | |
| 4,652,057 | 3/1987 | Engle et al. . | |
| 4,702,291 | 10/1987 | Engle . | |
| 4,719,351 | 1/1988 | Engle . | |
| 4,776,648 | 10/1988 | Newton et al. . | |
| 4,883,000 | 11/1989 | Engle . | |
| 4,947,761 | 8/1990 | Engle . | |
| 4,973,206 | 11/1990 | Engle . | |
| 5,154,123 | 10/1992 | Loomer . | |
| 5,245,929 | 9/1993 | Wertz et al. | 104/29 |

FOREIGN PATENT DOCUMENTS

| | | | |
|---|---|---|---|
| 9001734 | 11/1990 | European Pat. Off. . | |
| 3834211 | 4/1990 | Germany | 104/29 |
| 97918 | 8/1979 | Japan | 104/29 |
| 162316 | 12/1979 | Japan | 104/49 |

*Primary Examiner*—Mark Tuan Le
*Attorney, Agent, or Firm*—James Ray & Associates

[57] ABSTRACT

System and method for loading and unloading highway vehicles for transportation over railroad lines. The system has a number of railroad vehicles, each having a deck for highway vehicles. The deck extends from a central portion of the vehicle to one or both ends of the railway vehicle. The invention includes a terminal which has at least one stationary railroad track portion which is connected to a railroad system outside of the terminal. The terminal also has number of moveable railroad track segments. These segments can be positioned in a first configuration in which they are aligned so that railroad vehicles can be rolled from one or more of the stationary railroad track segments onto the moveable railroad track segments. These segments can also be positioned in a second configuration in which at least one end of each of the railroad vehicles is positioned adjacent a dock or other surface for motor vehicles, so that highway vehicles can be moved from the railroad vehicles onto the surface for motor vehicles, or from the surface for motor vehicles to the railroad vehicles. The system is equipped to move the moveable track segments from the first configuration to the second configuration, and back to the first configuration. The surface for motor vehicles is connected to a highway system outside of the terminal.

22 Claims, 8 Drawing Sheets

ROLL ON— ROLL OFF BIMODAL TERMINAL SYSTEM

FIELD OF THE INVENTION

The present invention relates, in general, to a terminal for loading highway vehicles onto railroad vehicles, and for unloading highway vehicles from railroad vehicles.

BACKGROUND OF THE INVENTION

In general, the most efficient point-to-point transportation of freight combines the best features of the railroad system and the highway system. Highway vehicles are preferred for reaching almost all addresses because of the ubiquity of the highway system. However, for long distance transportation the railroad system is most efficient.

One method of exploiting the advantages of the two systems is to use highway vehicles to pick up freight at specific addresses, and then to load the highway vehicles onto railroad vehicles for long distance transportation. Then, in the vicinity of the destination, the highway vehicles are off-loaded, and used to carry the freight to the final addresses.

Most commonly, the highway vehicles are tractor trailer combinations. After picking up freight at specific addresses, the vehicles are driven onto railroad vehicles, the tractors are uncoupled and driven off the railroad vehicles, leaving the trailers on the railroad vehicles. At the destination, tractors are driven onto the railroad vehicles, connected to the trailers, and used to pull the trailers off of the railroad vehicles and to the final addresses.

Most commonly, loading and unloading of highway vehicles onto railway vehicles is accomplished by "circus". In this procedure, a consist of coupled railroad cars, which may be, for example, flat cars or box cars, are moved into a position in which one end of the consist is adjacent a dock for motor vehicles. Plates are positioned so as to provide a roadway between coupled railway vehicles. Tractors are used to pull trailers onto the railway cars, and then backed out, one at a time. A consist including a locomotive then pulls the consist on which the trailers are carried to a destination terminal. At the destination terminal, the consist is again positioned adjacent a dock for motor vehicles, and tractors are backed onto the railroad cars, coupled to the trailers, and used to pull the trailers off the consist of railway vehicles. Stanchions on the railway vehicles may be used to secure the front ends of the trailers.

The procedures cited above are quite time-consuming, and accordingly various other methods of loading trailers onto or removing trailers from railway vehicles have been contemplated, and some have been employed.

One approach is to use a structure for supporting a trailer on a flatcar, the structure being pivoted about a vertical pivot. The structure may be swung to a position parallel to the railroad vehicle for travel, and may be swung to a position at an angle so the trailers can be moved off of and onto an adjacent motor vehicle dock. Examples are U.S. Pat. No. 4,129,079 and PCT publication number WO 91/07301.

An approach similar to the above employs a rotary loader attached to the dock. It is rotated so a portion of it is extended over the railway vehicle so trailers can be moved on and off of the railway vehicles. This is U.S. Pat. No. 4,483,652.

Another approach is to use a moveable ramp, which can be moved along the edge of a dock adjacent the railway vehicles, and extend bridges to a position oblique to the railway vehicles and the edge of the dock so that trailers can be moved onto and off of the railway vehicles. U.S. Pat. No. 4,190,393 employs this approach.

U.S. Pat. No. 2,920,580 provides an interesting approach in which a consist of railway vehicles are moved along a stretch of track which has switches which are used to switch the front bogeys of each railway vehicle onto one track, and to switch the rear bogeys onto another track. These tracks lead away from each other and then run parallel to each other at a separating distance about equal to the distance between bogey pivots on the two vehicles. The railway vehicles then are about perpendicular to loading docks, and trailers can be pulled onto the railway vehicles. Pivots joining the bogeys to the railway vehicles must accommodate relative angles of 90 degrees, and energy is stored in springs as the perpendicular configuration is obtained, so that the cars can be straightened out subsequently.

Other approaches include apparatus for lifting the highway vehicles and placing them on the railroad vehicles. The required machinery for lifting the vehicles is very large, and the method cannot readily be used for tank cars without the addition of a large amount of structure to the tank cars.

SUMMARY OF THE INVENTION

In one aspect, the present invention provides a system for loading and unloading highway vehicles for transportation over railroad lines. The system has a number of railroad vehicles, each having a deck for highway vehicles. The deck extends from a central portion of the vehicle to one or both ends of the railway vehicle.

The invention includes a terminal which has at least one stationary railroad track portion which is connected to a railroad system outside of the terminal. The terminal also has number of moveable railroad track segments. These segments can be positioned in a first configuration in which they are aligned so that railroad vehicles can be rolled from one or more of the stationary railroad track segments onto the moveable railroad track segments by a locomotive or other motive means. These segments can also be positioned in a second configuration in which at least one end of each of the railroad vehicles is positioned adjacent a dock or other surface for motor vehicles, so that highway vehicles can be moved from the railroad vehicles onto the surface for motor vehicles, or from the surface for motor vehicles to the railroad vehicles. The system also has motive means for moving the moveable track segments from the first configuration to the second configuration, and back to the first configuration.

The surface for motor vehicles is connected to a highway system outside of the terminal.

In another aspect, the present invention provides a method of loading a freight carrying highway vehicle onto a railroad vehicle, the railroad vehicle having a deck for highway vehicles. The method includes the step of moving the railroad vehicle from a first stationary track portion in a terminal onto a section of moveable track, so that the railroad vehicle is supported on the section of moveable track. This is done at a time when the section of moveable track is aligned with the first stationary track portion. The method includes providing a dock or other surface for motor vehicles, the elevation of the dock or other surface being about equal to the elevation of the deck of the railroad vehicle.

The method includes the step of displacing the section of moveable track so that one end of the deck of the railroad vehicle is moved to a position adjacent the surface for support of motor vehicles, and moving highway vehicles from the dock or other surface onto the deck of the railroad vehicle. The section of moveable track is then moved to align it with a stationary track portion, and the railroad vehicle is moved onto the stationary track portion, so it is ready for travel on a railroad system outside of the terminal.

In a further aspect, the present invention provides a method of unloading a freight carrying highway vehicle from a railroad vehicle which has a deck for highway vehicles onto a surface for support of motor vehicles in a terminal. The method includes the step of moving the railroad vehicle from a first stationary track portion which is connected to a railroad track system outside of the terminal onto a section of moveable track, so that the railroad vehicle is supported on the section of moveable track. This is done at a time when the section of moveable track is aligned with the first stationary track portion.

The method includes the step of displacing the section of moveable track so that one end of the deck of the railroad vehicle is moved to a position adjacent the surface for support of motor vehicles, which has an elevation about equal to the elevation of the deck of the railroad vehicle. The highway vehicle is then moved from the deck of the railroad vehicle onto the dock or other surface for motor vehicles.

The section of moveable track is then moved to a position where it is aligned with a stationary track portion, and the railroad vehicle is moved onto the stationary track portion.

OBJECTS OF THE INVENTION

It is, therefore, one of the primary objects of the present invention to provide a system and a method for transporting highway vehicles over railroad lines.

It is an additional object of the present invention to provide a system and method for loading highway vehicles onto railroad vehicles, and for unloading highway vehicles from the railroad vehicles.

It is a further object of the present invention to provide a system and method for loading highway vehicles onto railroad vehicles, which avoids the time consuming feature characteristic of "circus" loading in which a tractortrailer combination is backed from a dock at one end of a consist of coupled railroad vehicles down the same portion of the length of the consist, whereupon the tractor is uncoupled and driven back to the dock.

It is yet another object to provide a system and method for unloading highway vehicles from railroad vehicles, which avoids the time consuming feature characteristic of "circus" unloading in which a tractor is backed from a dock at one end of a consist of coupled railroad vehicles down some portion of the length of the consist, connected to a trailer and used to pull the trailer off of the consist onto the dock.

Still another object of the present invention is to provide a terminal for loading highway vehicles onto railroad vehicles and unloading highway vehicles from railroad vehicles which requires a minimum amount of land.

Yet another object of the present invention is to provide a terminal for loading highway vehicles onto railroad vehicles and unloading highway vehicles from railroad vehicles which does not require an excessive capital investment in structures and machinery.

Still a further object of the present invention is to provide a terminal for loading highway vehicles onto railroad vehicles and unloading highway vehicles from railroad vehicles which does not require a gantry or other crane.

In addition to the various objects and advantages of the present invention which have been generally described above, there will be various other objects and advantages of the invention that will become more readily apparent to those persons who are skilled in the relevant art from the following more detailed description of such invention, particularly, when such detailed description is taken in conjunction with the attached drawing figures and with the appended claims.

Figure 1:
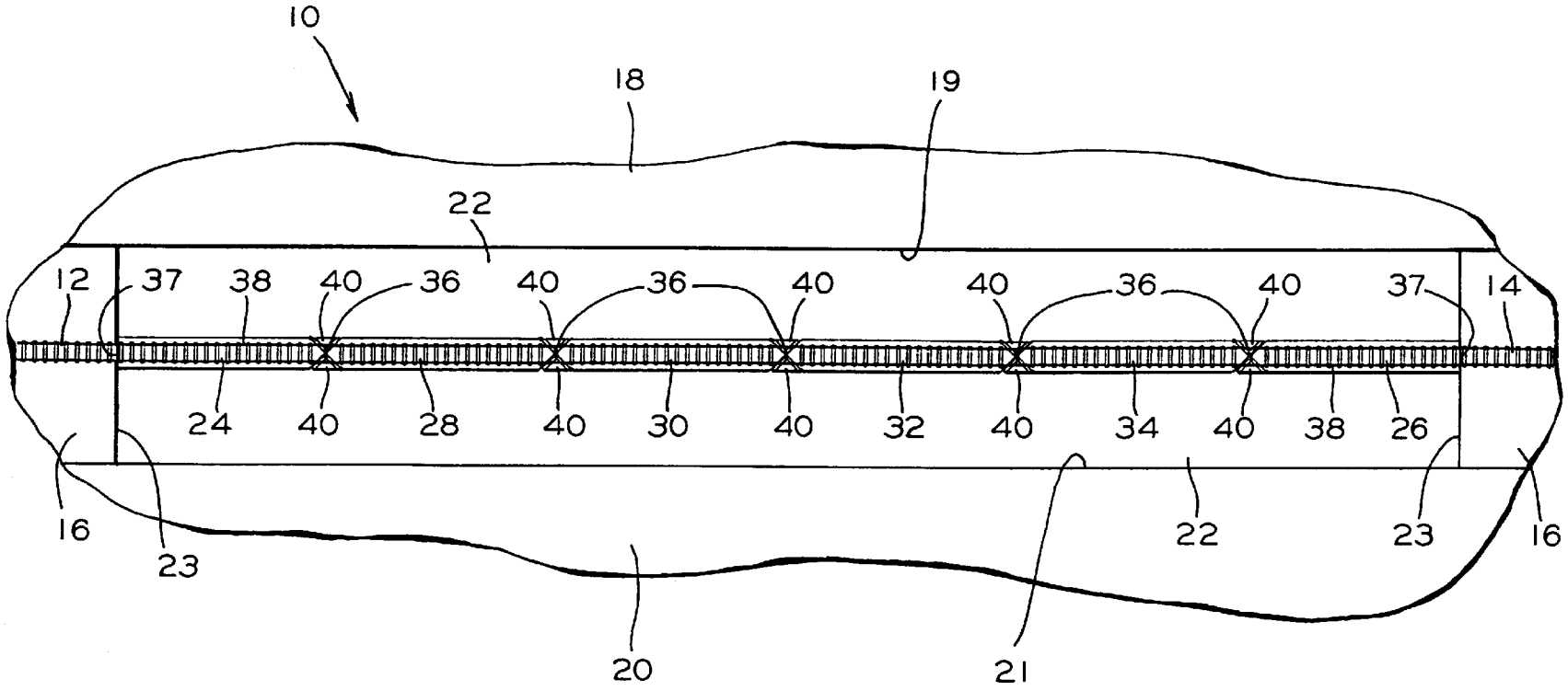
FIG. 1 shows a plan view of a terminal of the present invention with trusses in a configuration for connection to an external track system.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures, for the sake of clarity and understanding of the invention.

FIGS. 1 through 6 show the presently most-preferred embodiment of the invention. FIG. 1 shows a plan view of terminal 10. Railroad track portion 12 and railroad track portion 14, both of which are connected to a railroad system outside of terminal 10. The railroad track portions 12 and 14 are placed on surfaces 16. The terminal has motor vehicle docks 18 and 20. The edge of dock 18 is denoted 19, and the edge of dock 20 is denoted 21. Pit 22 is located between dock 18 and dock 20. Pit 22 is bounded on its ends by end wall 23. Pit 22 is lower than surface 16, which, in turn, is lower than dock portions 18 and 20.

Track segments 38 on trusses 24,26,28,30,32 and 34 are for supporting railway vehicles. Trusses 28,30,32 and 34 have two pivoted ends 36 for connection to adjacent trusses. Trusses 24 and 26 may each have one pivoted end 36, and an unpivoted end 37. If it is desirable to fabricate all the trusses identically, trusses 24 and 26 may be made each with two pivoted ends. In this case, track portions 12 and 14 and surface 16 could be notched to mate with tapered ends 36.

Figure 2:
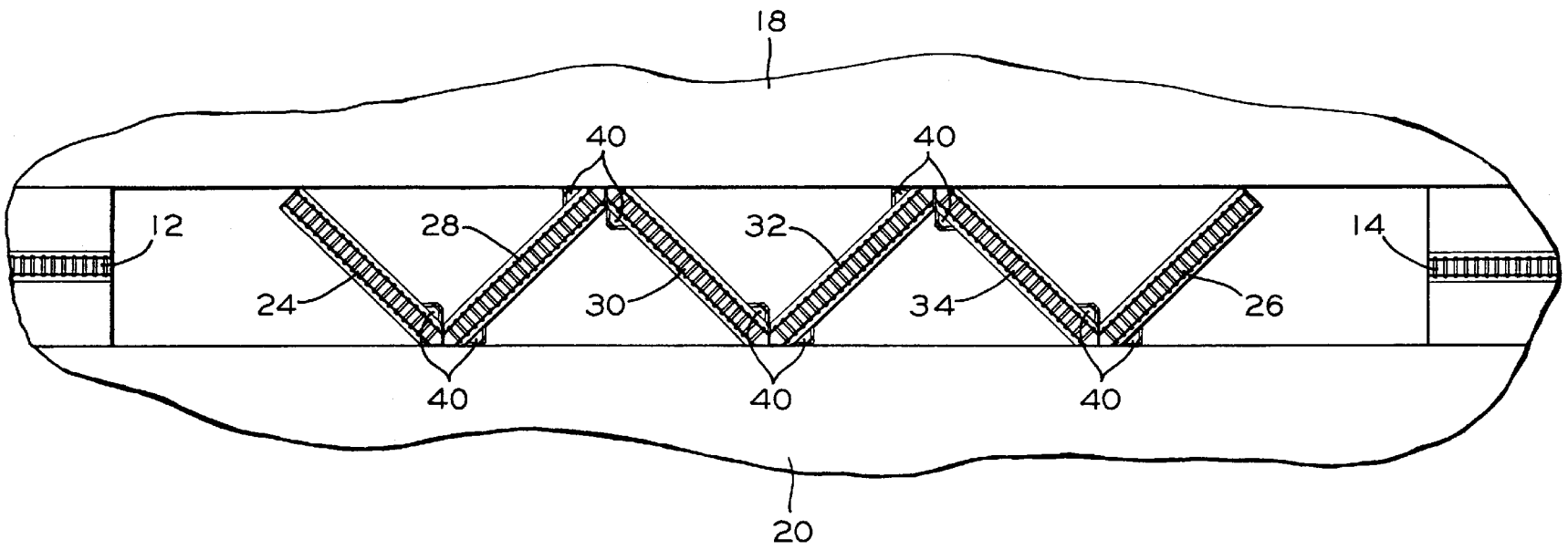
FIG. 2 shows a plan view of the terminal with trusses configured for loading and unloading highway vehicles from railroad vehicles on the trusses.

FIG. 2 shows trusses 24,26,28,30,32, and 34 positioned with their ends adjacent edge 19 of dock 18, and edge 21 of dock 20. Means for supporting the trusses and for moving them from the configuration seen in FIG. 1 to the configuration shown in FIG. 2 are not shown in these figures.

Figure 3B:
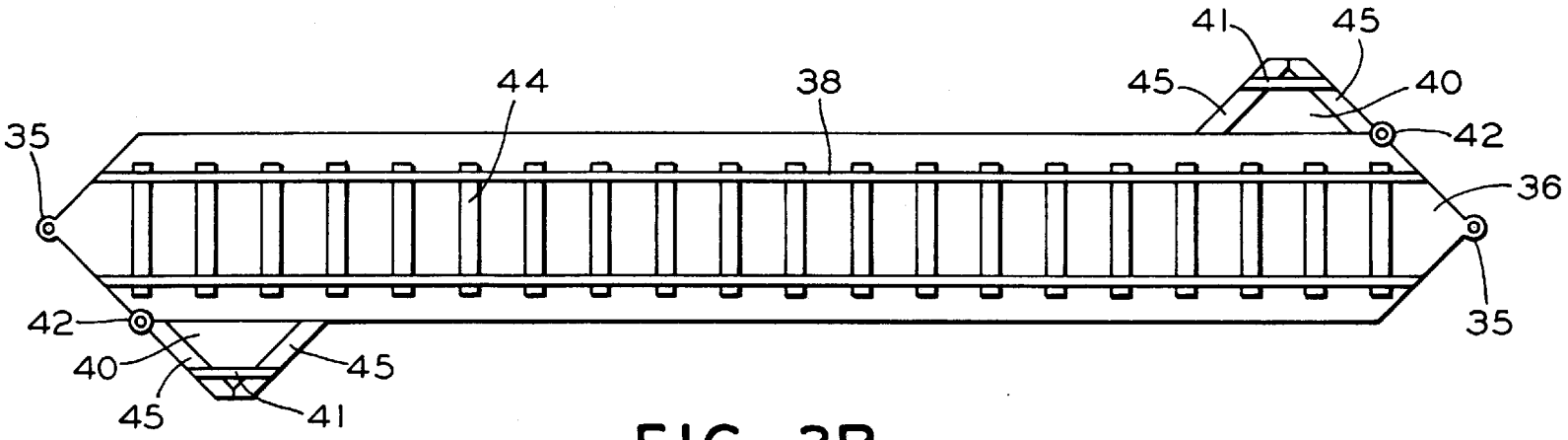
FIG. 3B shows a top view of a truss configured for positioning railway vehicles for loading and unloading highway vehicles.
Figure 3A:
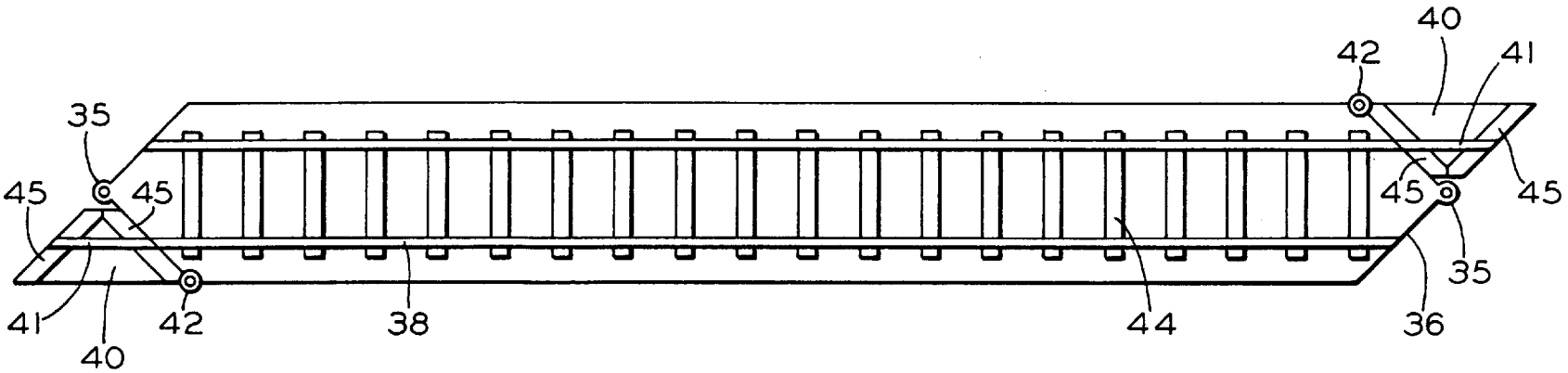
FIG. 3A shows a top view of a truss configured for coupling to adjacent trusses.

FIGS. 3A and 3B show top views of trusses 28, 30, 32, or 34, in greater detail. Track 38 is shown, supported on ties 44. Ties 44 are not mandatory, track segments 38 may be attached directly to the trusses. These figures show triangular hinged bridge portions 40 which support short track segments 41. Short track segments 41 are supported on short tie segments 45. Hinged bridge portions 40 are connected to trusses 28, 30, 32, and 34, as well as the end trusses 24 and 26. They are provided as needed to provide continuous railroad track including rails 38 and 41, between the trusses. Trusses 24 and 26 are similar to the truss shown, but have only one end with tapered portion 36, pivot 35, pivot 42 and triangular hinged bridge portion 40.

FIG. 3A shows the triangular bridge portions 40 positioned for aligning short track segments 41 with track segments 38, so that railroad vehicles can roll along continuous track from one segment to the next. FIG. 3A corresponds to the configuration shown in FIG. 1.

FIG. 3B shows the triangular bridge portions 40 moved out of the way by rotation about pivots 42, so that connected trusses can be positioned with their ends 36 adjacent dock 18 or 20. It is preferred that the dock be somewhat undercut to accommodate the trusses, so that the truss end pivots of two joined trusses are directly underneath the dock edges 19 or 21. This is the configuration shown in FIG. 2.

Figure 4:
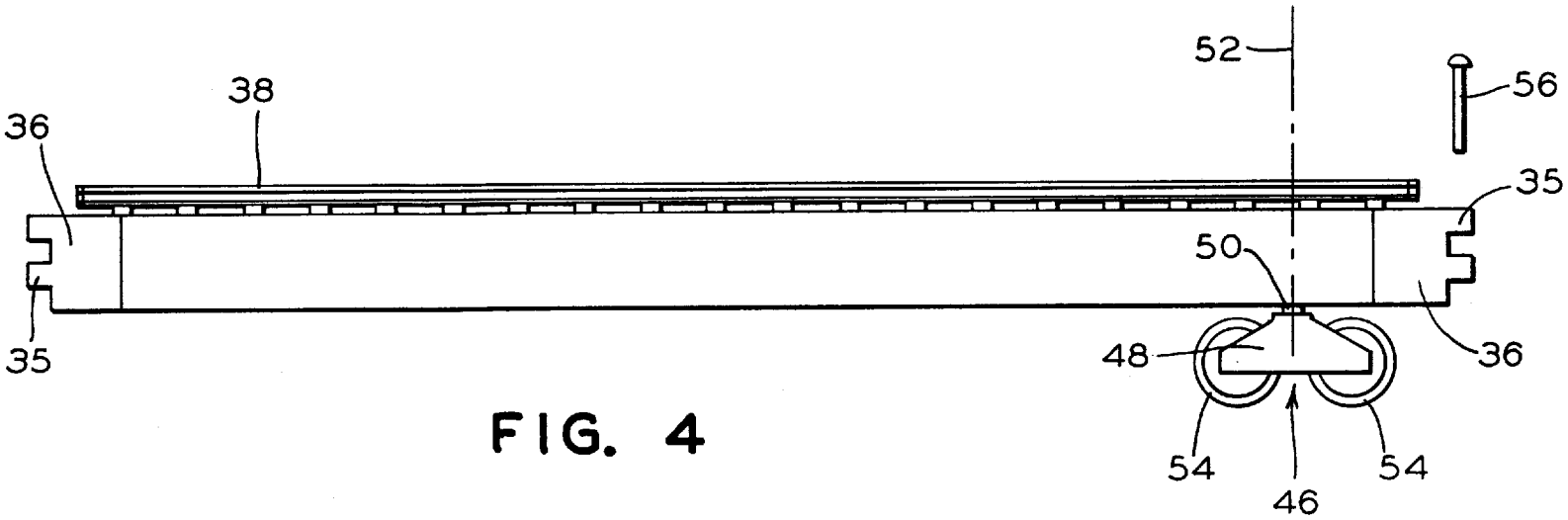
FIG. 4 shows a side elevation view of a truss.

FIG. 4 shows a side elevation of a truss which may be 28,30,32 or 34. The truss shown in FIG. 4 has a bogey 46 having body 48 on which wheels 54 are mounted. Bogey 46 does not require separate side frames and bolster, connected by springs, as is done in the conventional art of railway bogeys, because the present bogey is for riding on smooth, level track segments (described later). In this bogey, side frames and bolster may be constructed as an integral unit. Likewise brakes are not required. (The braking function can be provided by the motive means used for the trusses.) It is desirable for bogey 46 to be as short as possible, to reduce or eliminate the requirement for undercutting of docks 18 and 20. This is facilitated by the elimination of springs and brakes. Bogey 48 has pivot 50 which has vertical axis 52.

FIG. 4 shows tapered end portions 36 and pivots 35. Pivots 35 accommodate relative rotation of two connected trusses only about a vertical axis. The pivot connectors 35 do not need to be hermaphroditic, since the trusses never need to be turned end-to-end. The pivots 35 are shown exaggerated in size. Pivot 35 may be formed as a simple hinge having king pin 56. The triangular hinged bridge portions are not shown in this figure. Tapered end portions 36 are preferably tapered at an angle of 45 degrees.

Trusses 24,28,30,32 and 34 have only one bogey each. Loads on the end of these trusses which lack a bogey are communicated through pivot 35 to the next- truss which has a bogey at that end. Truss 26 has one bogey at each end. Trusses 24 and 26 have only one end having tapered end portion 36 and truss end pivot 35.

Figure 6:
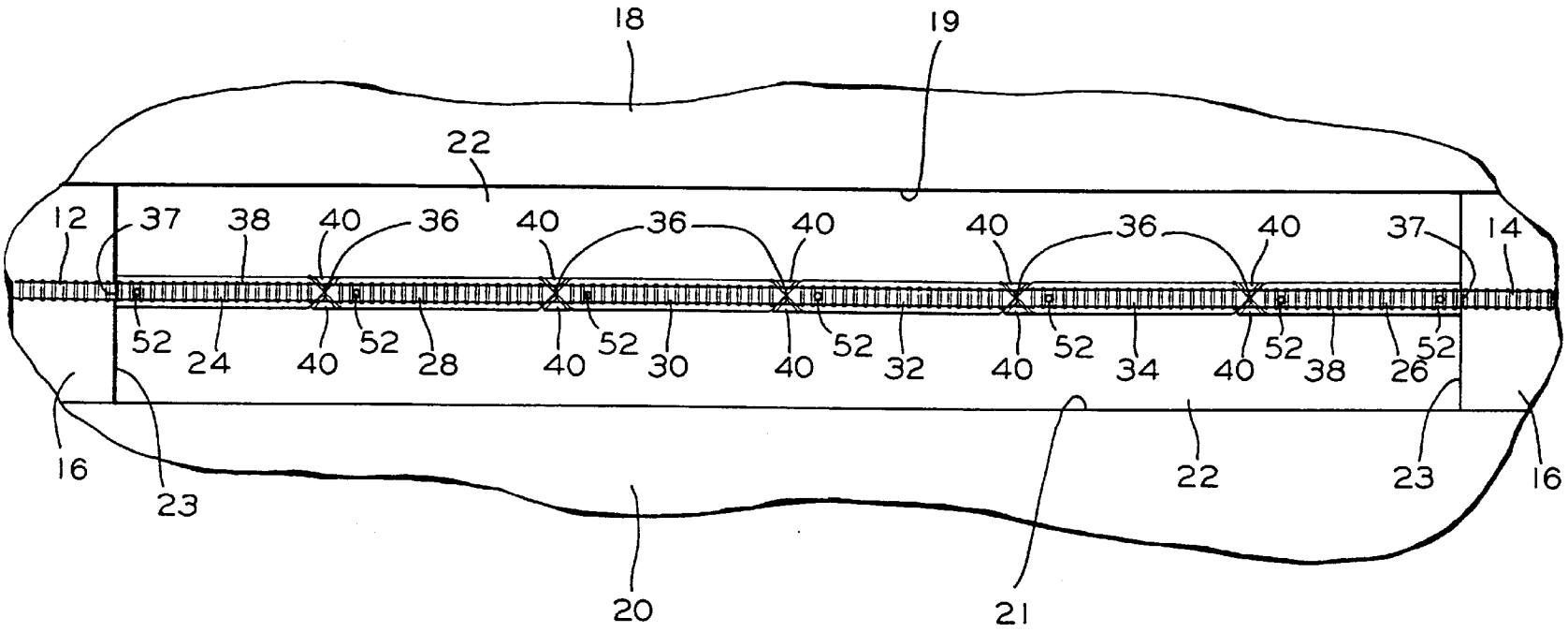
FIG. 6 shows a plan view of the terminal showing the locations of bogeys supporting the trusses when the trusses are aligned as in FIG. 1.
Figure 7:
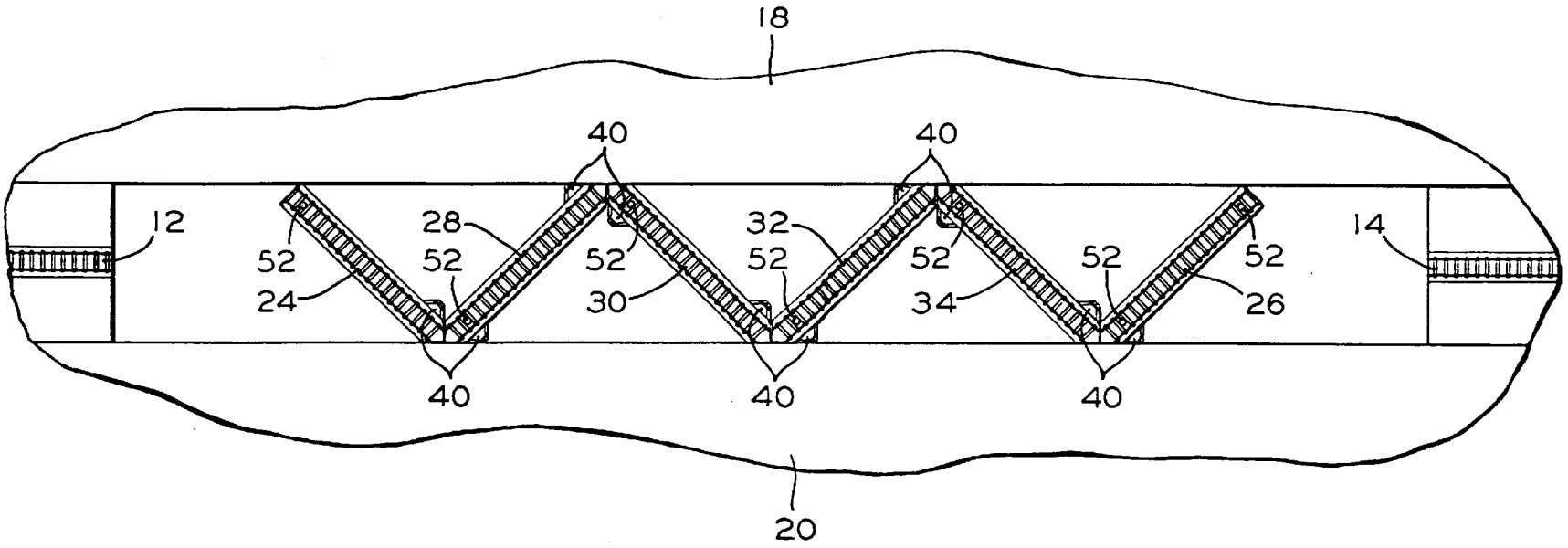
FIG. 7 shows a plan view of the terminal showing the locations of bogeys supporting the trusses when the trusses are aligned as in FIG. 2.

FIGS. 6 and 7 show views of the terminal, which are similar to FIGS. 1 and 2, respectively. FIG. 6 shows the system configured so the trusses are connected end-to-end, so that railroad cars can be rolled onto rails 38 and rail segments 41 from stationary track portions 14 and 16. FIG. 7 shows the trusses positioned with ends adjacent docks 18 and 20.

FIGS. 6 and 7 show the locations of the bogeys, which are shown by their axis. These are shown as points between the ties and are indicated as 52. These points, indicating bogey pivot locations, are shown on all the trusses.

Figure 5:
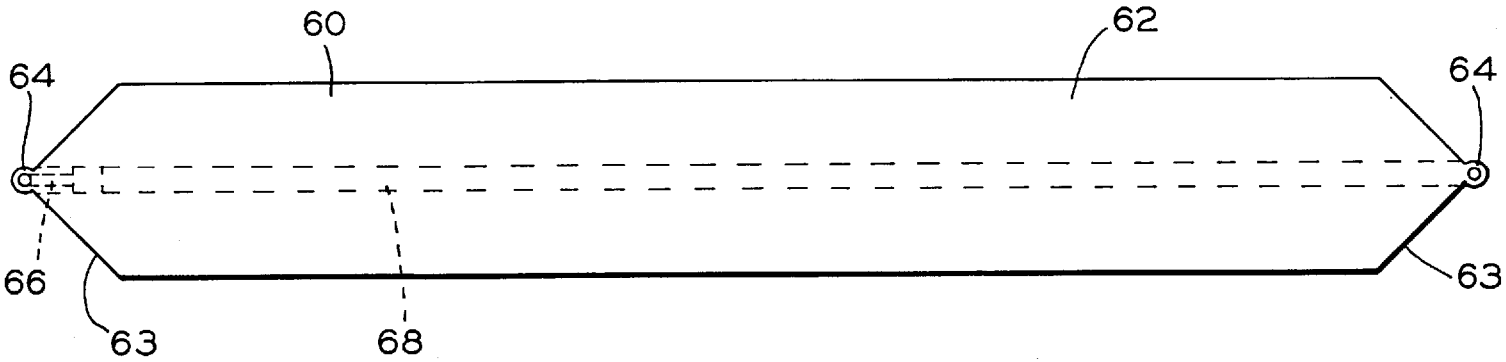
FIG. 5 shows the top view of a railroad vehicle according to this invention.

FIG. 5 shows a top view of a railroad vehicle 60 which is supported by one of the trusses, 24,26,28, 30, 32, or 34. Railroad vehicle 60 has deck 62 for motor vehicles. It has tapered ends 63. It is preferred that the ends 63 be tapered at 45 degrees, as shown, and should be the same as the tapered ends 36 of the trusses. Railroad vehicle 60 has yaw pivots 64 at its ends for connection to adjacent railroad vehicles 60". The distance between the yaw pivots 64 of railroad vehicle 60 must be very nearly the same as the distance between the end pivots of a truss, 35. When the railroad vehicles are rolled onto the trusses, they must be positioned so that the axis of their yaw pivots 64 are very nearly lined up with the axis of truss end pivots 35. The vehicle shown in FIG. 5 may be used for placement on trusses 28,30,32, and 34. Vehicles to be placed on trusses 24 and 26 have only one end tapered.

Since the railroad vehicles 60 are to travel on a railroad system outside of the terminal, the connections between adjacent vehicles 60 must accommodate pitch and roll, as well as yaw. If the railroad vehicle 60 has center sill 68, a pitch and roll pivot 66 may be placed between sill 68 and pivot 64 at the end of vehicle 60 on which pitch and roll pivot 66 is placed. Pitch and roll pivot 66 may be a conventional three axis coupler of the type used for coupling railroad vehicles which are joined in a built consist. As with truss end pivots 35, yaw pivots 64 do not need to be hermaphroditic. The reason for tapering the ends 63 of the railroad vehicles and end portion 36 of the trusses at 45 degrees is apparent from FIGS. 2 and 7. It is so that the railway vehicles 60, where they are connected to each other adjacent the dock edges 19 and 21, provide continuous deck surfaces for motor vehicles to be moved onto and off of the railway vehicles. Other taper angles may be used. However, dock plates to provide a continuous pathway may be required. With the present configuration, dock plates (not shown) are required only at the two ends of the railway vehicles and trusses which are not tapered.

Figure 8:
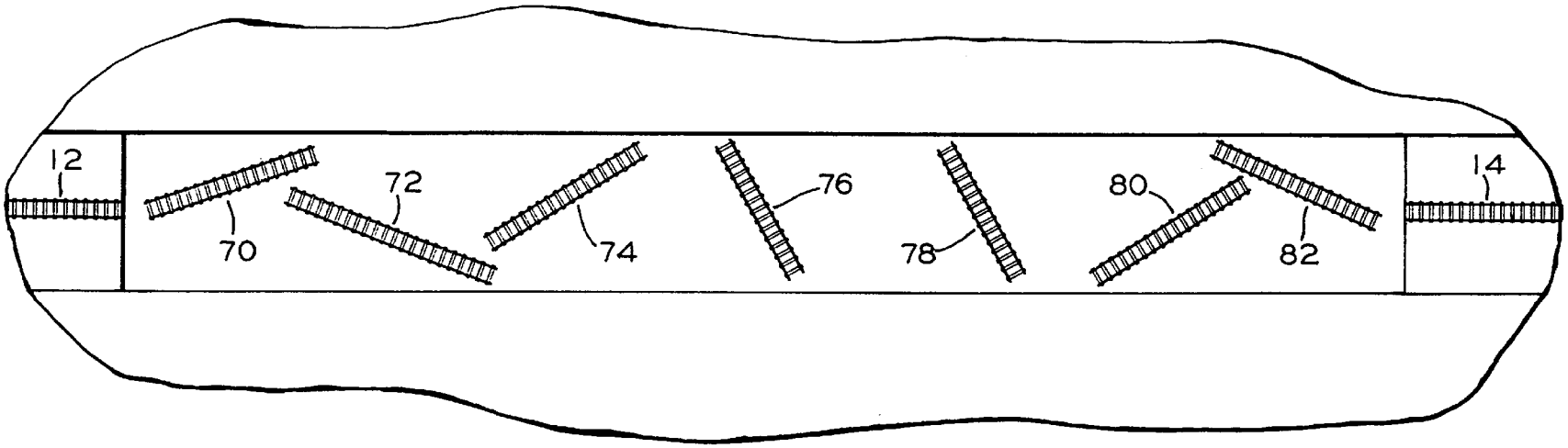
FIG. 8 shows track segments for support of bogeys on trusses.

FIG. 8 shows track segments placed on pit floor 22. These track segments are arranged for supporting the bogeys of trusses 24,26, 28,30,32, and 34. It is not mandatory that these track segments be standard gauge. Since they do not communicate with a railroad track system outside of the terminal, they can be any preferred gauge. In this preferred embodiment, it is preferred that these be standard gauge, so that standard wheel and axle sets may be used. Bogeys 46 should use the same gauge as these segments, since bogeys 46 roll on these segments.

Track segment 70 is for the bogey on truss 24. Its left end provides support for the bogey when the system is configured as in FIGS. 1 and 6, when all the trusses are lined up. Its right end provides support for the bogey when the system is configured as in FIGS. 2 and 7, when the trusses are positioned with their ends adjacent docks 18 and 20. Likewise track segment 72 provides support for the bogey on truss 28 in the two positions. Track segment 74 provides support for the bogey on truss 30. Track segment 76 provides support for the bogey on truss 32. Track segment 78 provides support for the bogey on truss 34. Track segments 82 are for support of the two bogeys on truss 26.

Very little motive power is needed for moving the trusses from the configuration shown in FIGS. 1 and 6 to the configuration shown in FIGS. 2 and 7. One method of supplying this motive power would be to have a small traction unit having an electric motor driving the axle of a powered bogey 46 on truss 32. An electric brake should also be provided on this or any other axle, to positively determine the positions of the bogeys. The electric motor may be driven by a cable having provisions for accommodating slack, to accommodate the two extreme positions of truss 32.

The embodiment described above is the presently most-preferred embodiment of the present invention. Other embodiments may use different numbers of trusses. The present invention employs six trusses. It is preferred that the number of trusses not exceed 10 if the railroad system is the North American system, because that is the maximum number of railroad cars that should be coupled together in a built consist, due to siding lengths in the North American system. If more trusses are added, it may be necessary to employ more than one traction unit on different trusses.

It is preferred that the system have two motor vehicle docks, 18 and 20, so that when the trusses are in the zig-zag configuration shown in FIGS. 2 and 7, tractor trailer combinations can be driven from either dock onto the decks of the railway vehicles, uncoupled, and driven off, onto the other dock. At the destination terminal, tractors can be backed onto each car (a short distance), coupled to the front ends of the trailers and used to pull the trailers onto the dock.

An alternative embodiment would use only one dock. This would require each tractor trailer combination to be backed onto the railway vehicles. This would be less desirable, but would be a vast improvement over methods such as "circus" loading which require backing the full length of the consist.

It is desirable to provide roadway communication between the two docks, 18 and 20. This may be done by having a grade crossing for motor vehicles to cross track segments 12 or 14. Alternatively, a moveable bridge may be used to provide roadway communication at the level of docks 18 and 20. The bridge should have a moveable portion, to permit railway vehicles to pass along the track segments 12 or 14.

Figure 9:
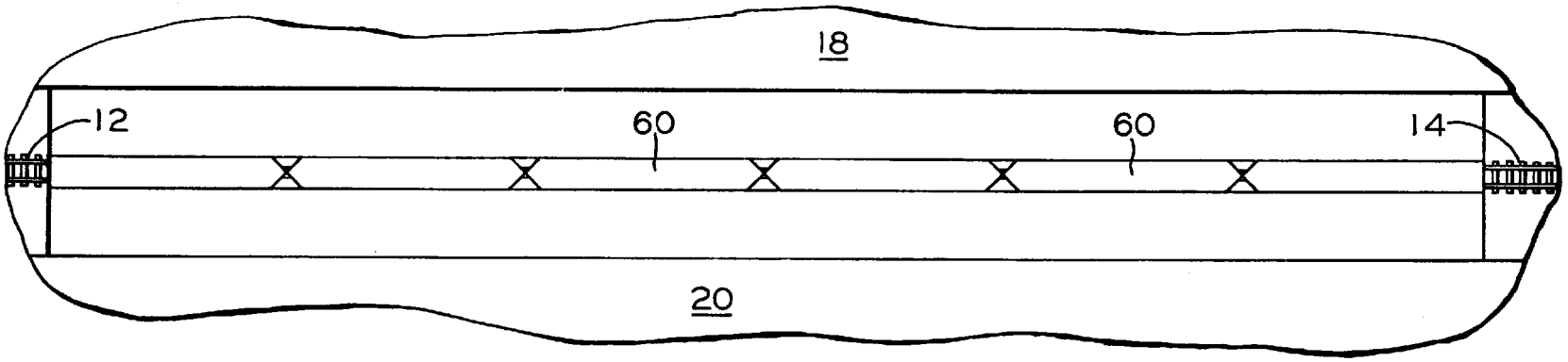
FIG. 9 shows railway vehicles in an aligned configuration.

FIG. 9 shows railway vehicles 60 positioned so they can be rolled onto and off stationary track segments 12 and 14.

Figure 10:
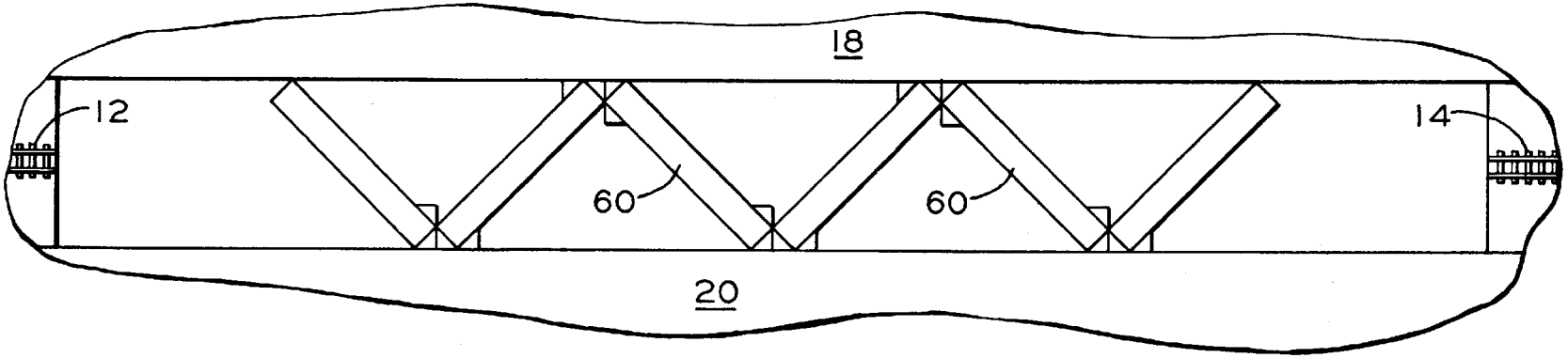
FIG. 10 shows railway vehicles in a zig-zag configuration for loading or unloading highway vehicles.

FIG. 10 shows railway vehicles 60 positioned with their ends adjacent motor vehicle docks 18 and 20, so that highway vehicles can be moved onto and off railway vehicles 60 or docks 18 and 20.

Now, discussing the invention more broadly, there is disclosed a system and a method for loading and unloading highway vehicles for transportation over railroad lines. The system has a plurality of railroad vehicles which have decks for highway vehicles. The decks extend from a central portion of the railroad vehicle to one or both ends of the railroad vehicle;

The system has a terminal, which has one or more stationary railroad track portions connected to a railroad system outside of the terminal. The system also has a number of moveable railroad track segments which can be positioned in a first configuration wherein they are aligned so that railroad vehicles can be rolled from one of the stationary railroad track segments onto the moveable railroad track segments by a railroad car positioning means, for example a small switchyard locomotive. The track segments also can be positioned in a second configuration such that a first end of each of the railroad vehicles is adjacent a first loading dock or other terminal surface on which highway vehicles may move, so that highway vehicles can be moved onto the railroad vehicles from the first terminal surface, and so that the highway vehicles can be moved from the railroad vehicles onto the first terminal surface.

The system has a motor vehicle pathway connecting the dock to a motor vehicle road system outside of the terminal. Means are provided for moving the moveable track segments from the first configuration to the second configuration, and from the second configuration back to the first configuration.

The system may also have a second dock or other terminal surface and the second configuration of the railroad vehicles may place a second end of each of the railroad vehicles adjacent the second dock or other terminal surface on which highway vehicles may move, so that highway vehicles can be moved onto the railroad vehicles from the second terminal surface, and so that the highway vehicles can be moved from the railroad vehicles onto the second terminal surface.

The system should also have motor vehicle connection between the second terminal surface and either the first terminal surface or a motor vehicle road system outside of the terminal. This may be a motor vehicle pathway which has a ramp descending from the first terminal surface down to the level of one of the stationary track portions, a grade crossing over the track, and a second ramp ascending to the level of the second terminal surface, so that motor vehicles may be driven between the first terminal surface and the second terminal surface. Such a connection may also be provided by a bridge, such as a drawbridge which has a moveable portion so the moveable portion can be positioned to permit motor vehicle communication between the first and second terminal surface, or positioned to permit railroad vehicles to move along the track portion.

The moveable track portions of the terminal may be supported on trusses, the trusses supported on moveable support means. The moveable support means may be constrained to move along a predetermined course. Stationary rail segments may be used for this. The moveable support means may include one or more wheeled vehicles. The moveable support means may alternatively be supported on other means a low friction pad, such as a lubricated polished surface, or a linear bearing.

The moveable support means may be supported on the stationary rail segments. One or more of the wheeled vehicles may have a flanged wheel for moving along one of the rails.

The system may include one or more dock plates positioned to support a highway vehicle when it is moved from one of the terminal surfaces to one of the railroad vehicles or from the railroad vehicle to the terminal surface.

The rail segments of the terminal may be substantially straight.

The trusses may have pivotal connection means, to be pivotally connected in serial order, one end of one truss connected to the other end of the next truss, etc. The railway vehicles should have the same length between couplings as the trusses, and they should be positioned so that the vertical axis provided by their couplings is over the axis of the truss pivots.

It is preferred that the trusses have tapered ends, and may require repositionable end portions for use when the trusses are positioned in a linear array, to permit railway vehicles to move from the stationary track portions connected to an outside railway system onto the line of trusses, and which are rotated out of the way when the trusses are positioned with their ends adjacent the docks or other terminal surfaces. It is preferred that the pivotal connection means accommodate a pivot angle of approximately 90 degrees, and that the railway vehicles meet the edge of the docks at 45 degrees.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

We claim:

1. A system for loading and unloading highway vehicles onto railroad vehicles, said system comprising (a) a plurality of pivotally connected railroad vehicles, each of said plurality of pivotally connected railroad vehicles having a deck for highway vehicles, said deck extending from a central portion of said railroad vehicle to at least one first end of said railroad vehicle;

(b) a terminal, said terminal having:

(i) at least one stationary railroad track portion (ii) a plurality of moveable railroad track segments;

(iii) means connected to said moveable railroad track segments for positioning said moveable railroad track segments in a first configuration and in a second configuration, said first configuration being an aligned configuration wherein said moveable railroad track segments are aligned in a line so that said plurality of pivotally connected railroad vehicles can be rolled from said at least one stationary track portion onto said moveable railroad track segments said second configuration being a zig-zag configuration such that a first end of each of said pivotally connected railroad vehicles is adjacent a first terminal surface on which highway vehicles may move, so that highway vehicles can be moved onto said railroad vehicles from said first terminal surface, and so that such highway vehicles can be moved from said railroad vehicles onto said first terminal surface.

2. A system according to claim 1 wherein said first terminal surface is a first dock portion.

3. A system according to claim 1 wherein said railroad vehicles are further characterized in that said deck for highway vehicles further extends from said central portion of said railroad vehicle to a second end of said railroad vehicle.

4. A system according to claim 3 further including a second terminal surface, and wherein in said second configuration of said movable track segments, said second end of each of said railroad vehicles is adjacent said second terminal surface on which highway vehicles may move, so that highway vehicles can be moved onto said railroad vehicles from said second terminal surface, and so that said highway vehicles can be moved from said railroad vehicles onto said second terminal surface.

5. A system according to claim 1 wherein said first terminal surface is positioned for connecting to a road system outside the terminal.

6. A system according to claim 4 wherein said second terminal surface is positioned for connecting to at least one of said first terminal surface and a road system outside the terminal.

7. A system according to claim 6 wherein said first and second terminal surfaces are positioned for connecting to vehicle ramps.

8. A system according to claim 5 wherein said first and second terminal surfaces are positioned for connecting to a movable bridge to permit roadway communication therebetween and to permit said railroad vehicles to pass along said at least one stationary railroad track portion.

9. A system according to claim 1 wherein said moveable track segments of said terminal are supported on trusses.

10. A system according to claim 9 wherein each of said trusses is supported on at least one moveable support means.

11. A system according to claim 10 further having means for constraining said moveable support means to move along a predetermined course.

12. A system according to claim 11 wherein said means for constraining said moveable support means includes one or more stationary rail segments.

13. A system according to claim 12 wherein said moveable support means includes at least one wheeled vehicle.

14. A system according to claim 12 wherein said moveable support means is capable of accommodating at least a low friction pad.

15. A system according to claim 12 wherein said moveable support means is capable of accommodating at least one linear bearing means.

16. A system according to claim 12 wherein said moveable support means are supported on said stationary rail segments.

17. A system according to claim 13 wherein at least one wheel of said at least one wheeled vehicle is a flanged wheel.

18. A system according to claim 1 wherein the railroad vehicles have a structure for providing a substantially continuous transition between the railroad vehicles and the terminal surface, for allowing highway vehicles to move between the railroad vehicles and the terminal surface.

19. A system according to claim 12 wherein said stationary rail segments are substantially straight.

20. A system according to claim 9 wherein said trusses have pivotal connection means at their ends, and are pivotally connected in serial order.

21. A system according to claim 9 wherein a plurality of said trusses have at least one repositionable end portion, which is repositioned after said railroad vehicles are rolled onto said moveable track segments to prevent a first end portion of one of said trusses from interfering with a second end portion of an adjacent truss to which it is pivotally connected when said moveable railroad track segments are in said zig-zag configuration.

22. A system according to claim 20 wherein said pivotal connection means accommodate a pivot angle of approximately 90 degrees.

* * * * *